US007070543B1

(12) United States Patent
Rindfleisch

(10) Patent No.: US 7,070,543 B1
(45) Date of Patent: Jul. 4, 2006

(54) EXERCISE MACHINE WITH LEVERAGE ARM

(76) Inventor: Randy Rindfleisch, 810 N. 28th St., Sheboygan, WI (US) 53081

( * ) Notice: Subject to any disclaimer, the term of this patent is extended or adjusted under 35 U.S.C. 154(b) by 445 days.

(21) Appl. No.: 10/233,036

(22) Filed: Sep. 3, 2002

(51) Int. Cl.
*A63B 21/08* (2006.01)
*A63B 21/78* (2006.01)
*A63B 23/02* (2006.01)
*A63B 23/35* (2006.01)

(52) U.S. Cl. ..... 482/97; 482/72; 482/80; 482/98; 482/104; 482/140; 482/137

(58) Field of Classification Search ..... 482/92–94, 482/97, 98, 100, 104, 137, 72, 80, 140
See application file for complete search history.

(56) References Cited

U.S. PATENT DOCUMENTS 3,010,720 A * 11/1961 Allard ..... 482/97
4,231,570 A 11/1980 Reis
4,262,901 A 4/1981 Faust
4,306,715 A 12/1981 Sutherland
4,357,010 A * 11/1982 Telle ..... 482/97
4,368,884 A 1/1983 Colvin
4,405,128 A * 9/1983 Mclaughlin et al. ..... 482/97
4,411,425 A 10/1983 Milnar
4,461,473 A 7/1984 Cole
4,527,797 A 7/1985 Slade, Jr. et al.
4,635,930 A 1/1987 Cormier
4,722,522 A * 2/1988 Lundgren ..... 482/97
4,757,998 A 7/1988 Landin
4,765,611 A * 8/1988 MacMillan ..... 482/98
4,799,673 A 1/1989 Selle
4,826,155 A 5/1989 James
4,840,373 A 6/1989 Maag
4,854,578 A 8/1989 Fulks
4,872,670 A * 10/1989 Nichols ..... 482/135
4,917,379 A * 4/1990 Maag ..... 482/97
4,923,195 A * 5/1990 Calderone ..... 482/97
5,006,004 A 4/1991 Dirksing et al.

(Continued)

FOREIGN PATENT DOCUMENTS

FR 1447999 * 6/1966 ..... 482/104

(Continued)

OTHER PUBLICATIONS

Nebula Fitness Equipment by Proto Weld inc., Seated Calf # 6070, catalog received at PTO Sep. 1995.*

*Primary Examiner*—Jerome Donnelly
*Assistant Examiner*—Victor K. Hwang
(74) *Attorney, Agent, or Firm*—Ryan Kromholz & Manion, S.C.

(57) ABSTRACT

An exercise machine utilizes the inherent capabilities of human muscles to exert greater forces during eccentric functions than during concentric functions. The exercise machine comprises a leverage arm pivotally connected to a frame. A force station is at a first distance from the pivotal connection. During a concentric muscle function, a person lifts first weights on the leverage arm. At the end of the concentric muscle function, a spotter applies a small force to the leverage arm at a second distance greater than the first distance from the pivotal connection. The small force produces a magnified load at the force station that the person resists during an eccentric muscle function. The leverage arm may be adjustable relative to the floor. The weight of the leverage arm may be counterbalanced. Various embodiments of the exercise machine utilize the same principles of physics for exercising different muscles.

30 Claims, 9 Drawing Sheets

U.S. PATENT DOCUMENTS 5,011,140 A * 4/1991 Adessi ..... 482/97
5,044,631 A 9/1991 Jones
5,050,873 A 9/1991 Jones
D321,026 S 10/1991 Jones
D321,027 S 10/1991 Jones
5,052,684 A 10/1991 Kosuge et al.
D321,387 S 11/1991 Jones
D321,389 S 11/1991 Jones
D321,390 S 11/1991 Jones
D321,391 S 11/1991 Jones
5,066,003 A 11/1991 Jones
5,100,080 A 3/1992 Servanty
5,108,095 A * 4/1992 Nichols ..... 482/137
5,116,297 A * 5/1992 Stonecipher ..... 482/97
5,125,881 A 6/1992 Jones
5,135,449 A 8/1992 Jones
5,135,456 A 8/1992 Jones
5,141,480 A 8/1992 Lennox et al.
5,171,198 A 12/1992 Jones
5,180,354 A 1/1993 Jones
5,181,896 A 1/1993 Jones
5,183,452 A * 2/1993 Bacon et al. ..... 482/97
5,194,060 A * 3/1993 Marchetti ..... 482/97
5,217,421 A 6/1993 Chrysler
5,273,504 A 12/1993 Jones
5,273,505 A 12/1993 Jones
5,281,193 A 1/1994 Colbo, Jr.
5,306,220 A 4/1994 Kearney
5,310,393 A * 5/1994 Highsmith et al. ..... 482/93
5,346,448 A 9/1994 Sollo
5,358,462 A * 10/1994 Calderone ..... 482/137
5,518,482 A 5/1996 Hsieh
5,562,577 A * 10/1996 Nichols, Sr. et al. ..... 482/97
5,613,928 A 3/1997 Laudone
5,643,152 A 7/1997 Simonson
5,667,464 A 9/1997 Simonson
5,755,823 A 5/1998 Cleary
5,769,757 A 6/1998 Fulks
5,788,605 A 8/1998 Kuo
5,810,701 A 9/1998 Ellis et al.
5,833,585 A 11/1998 Jones et al.
6,224,518 B1 5/2001 Weiss et al.
6,394,937 B1 5/2002 Voris
6,500,106 B1 12/2002 Fulks
2002/0198088 A1 12/2002 Vuurmans et al.

FOREIGN PATENT DOCUMENTS

FR 2561528 A1 * 9/1985
FR 2612406 9/1998
GB 2232089 A * 12/1990
WO WO 89/01805 3/1989

* cited by examiner

EXERCISE MACHINE WITH LEVERAGE ARM

BACKGROUND OF THE INVENTION

1. Field of the Invention

This invention pertains to exercise machine, and more particularly to apparatus that produces different loads during concentric and eccentric muscle functions of an exercising person.

2. Description of the Prior Art

The physiology of human muscles enables them to function in three different ways. The first is a positive or concentric function in which the muscles contract under a load that is less than the muscle strength. The second way is a static or isometric function in which the muscle attempts to contract against a load that is greater than the muscle strength. The third muscle function is a negative or eccentric function in which an external load is large enough to overcome the muscle strength and force the muscle to elongate in spite of an attempt by the person to contract the muscle.

It is well known that muscles perform much more efficiently during eccentric functions than during concentric or isometric functions. The same muscle can exert a greater force during eccentric functions than it can during either concentric or isometric functions. In addition, the energy expended, and the associated electrical activities or pulses of the muscle nervous system, are greater during concentric and isometric functions compared to eccentric functions when overcoming the same load.

Various types of equipment have been developed to assist persons exercise their muscles. The equipment ranges from simple hand-held barbells to complicated and expensive hydraulically controlled machines. Many machines are very specialized in that they are designed to exercise only one or a very limited set of muscles.

With only very few exceptions, prior exercise machines have not taken advantage of the muscle physiology related to the differences in efficiency between concentric and eccentric functions. Almost all known prior machines impose a single load that the person must overcome during both concentric and eccentric muscle functions. A few prior exercise machines were capable of imposing different loads for concentric and eccentric muscle functions, but those machines invariably included very expensive and complicated hydraulic systems.

Examples of prior mechanical exercise machines are plentiful. The Powertec Direct Company of Milford, Pa., markets a wide variety of equipment for exercising many of the body's muscles such as legs, back, chest, thigh, and arms. The Hammer Strength Company of Cincinnati, Ohio, and Promaxima Manufacturing Limited of Houston, Tex., also market respective lines of mechanical exercising equipment.

Many of the commercially available exercise machines utilize one or more pivoting beams. One end of the beam is pivoted to a frame. The beam supports one or more weights. The exercising person oscillates the beam and weights by alternately performing concentric and eccentric functions by the appropriate muscles. The beam and weight design of prior equipment imposes the same load for both the concentric and eccentric muscle functions.

A typical example of prior equipment is the bench press, such as is marketed by the Powertec Direct Company. Somewhat similar equipment is shown in PCT patent WO89/01805. Other examples of beam and weight type exercising machines may be seen in U.S. Pat. Nos. 5,050,873; 5,066,003; 5,125,881; 5,135,449; 5,135,456; 5,171,198; 5,180,354; 5,181,896; 5,273,504; 5,273,505; and Des 321,391. No machine of the foregoing patents gives any indication that different loads should be overcome by the person during concentric and eccentric functions of his muscles.

U.S. Pat. No. 4,826,155 shows equipment that takes into account the inherent ability of human muscles to perform differently during concentric and eccentric functions. The U.S. Pat. No. 4,826,155 shows a harness that is worn by an exercising person. A spotter operates a rope that is tied to the harness through a block and tackle in order to assist the person to raise weights during concentric muscle functions. During the eccentric muscle functions, the spotter allows an increased load to be imposed on the exercising person.

Despite the widespread availability of numerous different kinds of exercise machines, further improvements to them are desirable.

SUMMARY OF THE INVENTION

In accordance with the present invention, an exercise machine having a leverage arm is provided that greatly increases the efficiency of muscle development. This is accomplished by using the leverage arm to change the load a person must overcome during concentric and eccentric muscle functions.

The exercise machine is comprised of a frame that rests on a floor. A leverage arm is pivotally connected to the frame. The leverage arm includes a force station that pivots with the leverage arm relative to the frame. A support for a person is attached to the frame. The support and the force station are located relative to each other to enable a person to exercise a particular set of muscles. The force station is at a first distance that is as close as practical to the pivotal connection of the leverage arm to the frame. A spotter end of the leverage arm is at a second distance from the pivotal connection. Preferably, the ratio of the second distance to the first distance is approximately four to one. Depending on the particular muscles that are to be exercised, the force station may be on the same side or on the opposite side of the pivotal connection as the leverage arm spotter end. The leverage arm has weight bars for holding first weights. The weight bars may, but need not be, at the leverage arm spotter end.

According to one aspect of the invention, there is an adjuster on the leverage arm. The adjuster holds the leverage arm spotter end off the floor. The adjuster is adjustable on the leverage arm so as to vary the location of the force station relative to the support.

In use, an exercising person places desired first weights on the weight bars. A spotter stands adjacent the leverage arm spotter end. The person places himself in the appropriate way on the machine support. He contacts the force station with the appropriate part of his body. He exerts the appropriate muscles in a concentric function to overcome the gravitational load of the first weights and pivot the leverage arm upwardly.

At the end of the concentric muscle function, the spotter applies a small force on the spotter end of the leverage arm. The small force may be a small weight applied to the leverage arm. Alternately, the spotter may put downwardly on the leverage arm with his hands. The small force acts through the second distance between the leverage arm spotter end and the pivotal connection of the leverage arm with the frame to create a torque. Since the second distance is greater than the first distance between the force station and the pivotal connection of the leverage arm to the frame, a resultant load equal to the small applied force times the ratio of the second distance to the first distance is imposed at the force station. During the eccentric muscle function, therefore, the person exerts a force that resists the sum of the gravitational load of the first weights plus the resultant load of the small applied force. At the end of the eccentric muscle function, the spotter removes the small force from the leverage arm. The exercising person then repeats the concentric muscle function, again overcoming only the gravitational load produced by the first weights, and the cycle repeats. In that manner, the person makes maximum use of his different muscle abilities to overcome different loads during concentric and eccentric functions.

The weight of the leverage arm adds to the gravitational load of the first weights that the exercising person must overcome during concentric muscle functions and resist during eccentric muscle functions. In some instances, it may desirable to negate the weight of the leverage arm such that the person must exert muscle functions involving only the first weights and the small applied force. In those situations, the exercise machine of the invention is designed with a counterweight arm on the opposite side of the pivotal connection with the frame as the leverage arm. Counterweights are added to the counterweight arm such that a torque created about the pivotal connection between the counterweight arm and the frame by the counterweights equals the torque created by the weight of the leverage arm.

It is an important feature of the invention that it is adaptable to exercising any of a wide variety of muscles. In one embodiment the exercise machine is in the form of a bench press. Other embodiments are especially useful to enable a person to perform squat, leg extension, leg curl, leg press, and other well-known exercises. The different embodiments of the invention have the same basic frame and leverage arm. Only the support and the force station vary to suit the particular exercise to be performed. In each type of exercise machine, the same laws of physics are used by the leverage arm and small force applied to it by a spotter at the end of each concentric muscle function. As a result, maximum efficiency is attained for the particular muscle that is exercised on the machine.

The method and apparatus of the invention, using a leverage arm that produces a magnified load at a force station of a small force selectively applied to the leverage arm, thus greatly increases the efficiency of exercise workouts. The full ability of the exercising person to resist a greater load during eccentric muscle functions than he overcomes during concentric functions is realized, even though the spotter need apply only a small force.

Other advantages, benefits, and features of the present invention will become apparent to those skilled in the art upon reading the detailed description of the invention.

DETAILED DESCRIPTION OF THE INVENTION

Figure 1:
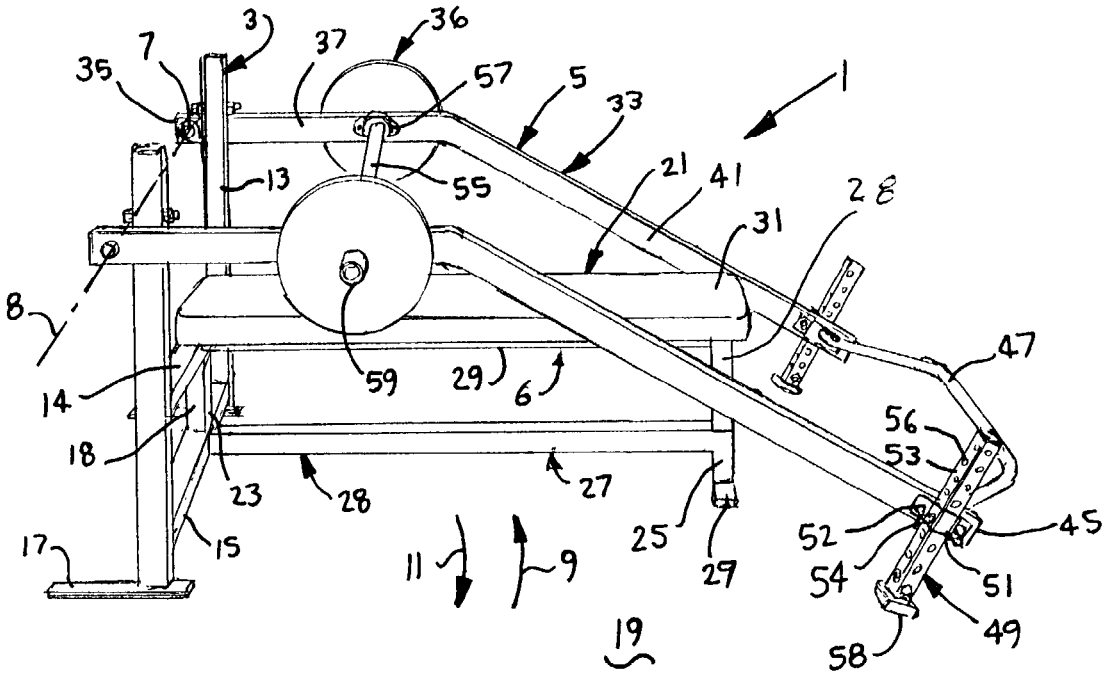
FIG. 1 is a perspective view of an exercise machine according to the present invention.

Referring first to FIG. 1, an exercise machine with a leverage arm 1 is illustrated that includes the present invention. The particular exercise machine 1 shown is in the general form of a bench press. However, as will be discussed in detail hereinafter, it will be understood that the invention is not limited to machines for exercising any specific human muscles. On the contrary, different embodiments of the invention are useful for exercising a wide variety of muscles.

The exercise machine 1 is comprised of a frame 3, a leverage arm 5, and a support 6. The leverage arm 5 is pivotally connected to the frame 3 at bearings 7. The bearings 7 define a common pivotal axis 8. The leverage arm 5 is pivotable in the directions of arrows 9 and 11 about the axis 8.

In the particular exercise machine 1 shown, the frame 3 is made with two upstanding posts 13 that are fixed to two transverse braces 14 and 15 of a stabilizer 27. The stabilizer 27 is perpendicular to the pivotal axis 8. A second end of the stabilizer 27 includes a short stub leg 25. On the bottom of the stabilizer stub leg 25 is a foot plate 29 that is supported on the floor 19. The stabilizer floor plate 29 cooperates with the post foot plates 17 to form a stable three-point tripod-type frame.

The support 6 of the exercise machine 1 is in the general form of a horizontal bench 21. The support has a first vertical leg 18 that is attached to the frame braces 14 and 15. A second vertical 28 upstands from the stub leg 25 of the frame 3. Between the tops of the legs 18 and 28 is a cross-plate 29. A horizontal pad 31 is on the cross-plate 29. The pad may be a sturdy flat board made of wood or similar material. The board is covered with a comfortable padding and durable cover, such as vinyl.

Figure 5:
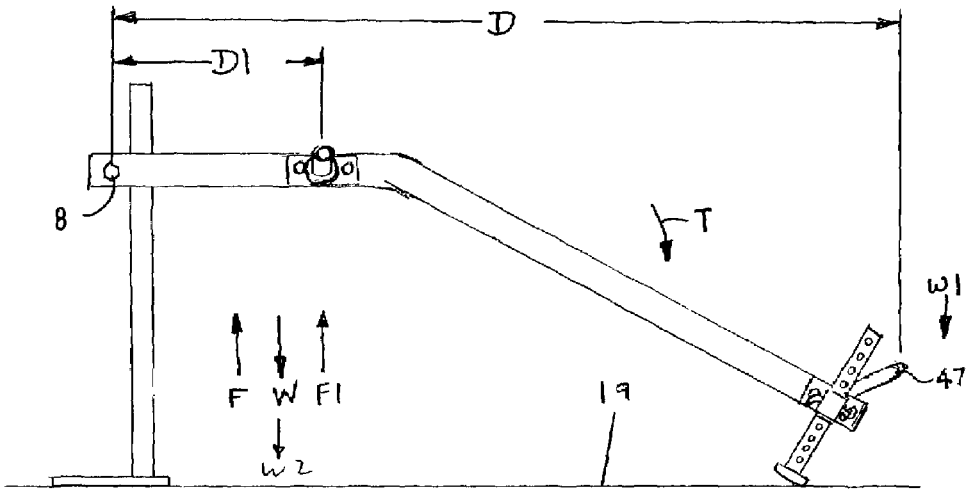
FIG. 5 is a schematic view of the forces and torques involved in the operation of the invention.

In the illustrated exercise machine 1, the leverage arm 5 is comprised of two parallel beams 33. A first end 35 of each beam 33 is pivotally connected to a respective frame post 13 by a bearing 7. Preferably, the bearings are in the form of pillow blocks that are bolted to the posts. Each beam has a first section 37 adjacent the first end 35, and a second section 41 next to the first section. In the illustrated construction, the second section 41 angles downwardly relative to the first section toward the floor 19. The second section terminates at a spotter end 45 of the beam. A spotter bar 47 is joined to the two beams near their respective spotter ends 45. The spotter bar 47 is at a distance D from the common pivotal axis 8 of the bearings 7. Also see FIG. 5. The spotter bar is preferably round in shape and is bowed outwardly from the beams spotter ends 45.

There is a beam adjuster 49 assembled to each beam 33 of the leverage arm 5. Each beam adjuster 49 is composed of a flanged channel 51 mounted to the associated beam by fasteners 52. A tubular column 53 is slideable between the beam and the channel 51. At the lower end of the column 53 is an enlarged foot 58 that rests on the floor 19. A pin 54 is removably insertable through an aligned set of holes in the channel and any of several holes 56 in the column. The columns can be slid in the channels to the desired position relative to the beams and maintained there by means of the pins 54. Consequently, the angular orientation of the leverage arm relative to the floor and to the bench 21 is adjustable.

Overlying the bench 21 is a force station 36. In the particular bench press exercise machine 1 shown, the force station 36 is in the form of a lift bar 55. The lift bar 55 extends between the first sections 37 of the beams 33. Preferably, the opposite ends of the lift bar are rotatably supported in respective pillow blocks 57 that are bolted to the beams. The lift bar is at a distance D1 from the pivotal axis 8 of the frame bearings 7, FIG. 5. For maximum comfort and effectiveness of the exercise machine, the lift bar is as close as practical to the pivotal axis.

Rigidly secured to and projecting outwardly from each first section 37 of each beam 33 is a weight bar 59. The weight bars 59 may be generally aligned with the lift bar 55. Preferably, the weight bars angle upwardly by approximately ten degrees.

Figure 2:
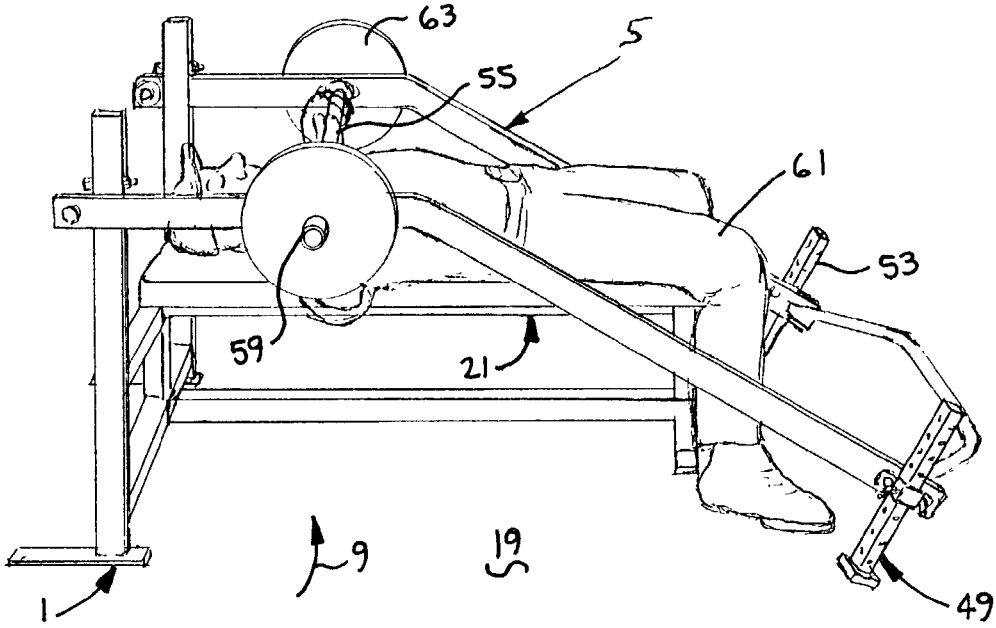
FIG. 2 is a view of the invention of FIG. 1 with an exercising person supported on the bench.
Figure 3:
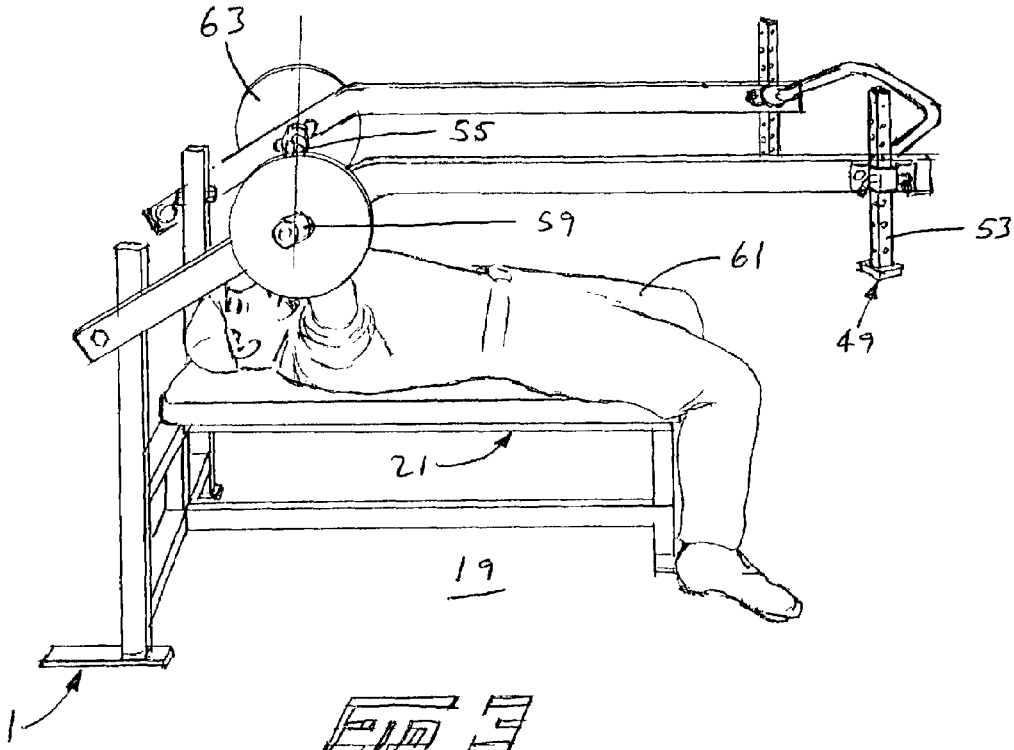
FIG. 3 is a view of the exercise machine and exercising person at the end of a concentric muscle function.

Turning to FIG. 2, the exercise machine 1 is used in the following manner. An exercising person 61 places a desired first weight 63 on each weight bar 59. He lies on his back on the bench 21, with his knees bent, his feet on the floor 19, and his chest under the lift bar 55. If necessary, the columns 53 of the adjusters 49 are adjusted such that there is the proper amount of space between the person's chest and the lift bar. With the person comfortably supported on the bench, he grasps the lift bars with both hands. He exerts a concentric function of the appropriate back, shoulder, and arm muscles with a force F slightly greater than the combined gravitational load W of the two first weights 63. As a result, the leverage arm 5, together with the first weights, pivots in the direction of arrow 9. The end of the concentric muscle function is shown in FIG. 3.

Figure 4:
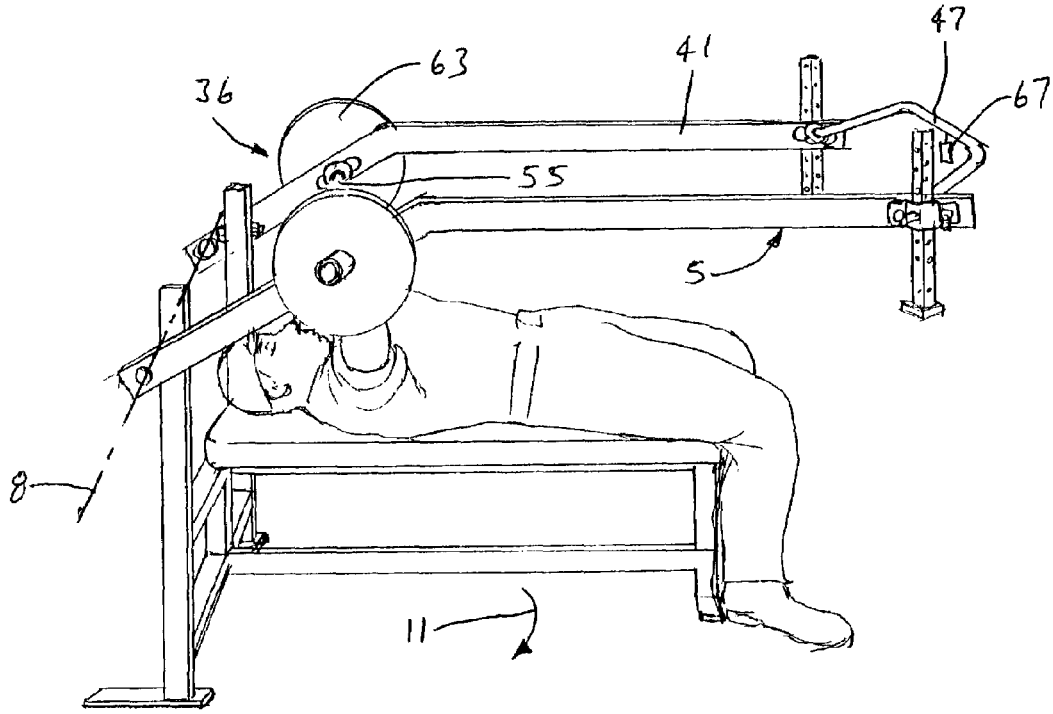
FIG. 4 is a view similar to FIG. 3, but showing a small weight applied to the leverage arm.

At the end of the concentric muscle function, a spotter, not shown, hangs a small weight 67 of weight W1 on the spotter bar 47. See FIG. 4. The bowed configuration of the spotter bar 47 provides room for the spotter to stand on the floor 19 without interfering with the exercising person 61. The small weight 67 acts through the distance D to create a torque T on the leverage arm 5. The torque T imposes a resultant load W2 at the force station 36 that is greater than the gravitational load W1 of the small weight 67 by the ratio of the distances D to D1. The total force F1 that must be resisted by the person is then equal to the sum of the load W due to the gravitational load of the first weights 63 plus the resultant load W2 due to the small weight 67. The person's muscles are capable of resisting the sum of the loads W and W2 during an eccentric function. Consequently, the person is able to pivot the leverage arm and weights 63 and 67 with complete control in the direction of arrow 11. At the end of the eccentric muscle function, the spotter removes the small weight 67. The exercising person then exerts just the force F again to lift the weights 63, and the process is repeated.

Instead of using a separate small weight 67 during eccentric muscle functions, the spotter may apply a small force to the spotter bar 47 by pushing downwardly lightly with his hands on the spotter bar 47. The manual force applied by the spotter is analogous to the weight W1 of the small weight 67. The small manual force acts through the distance D and imposes a resultant load W2 at the force station 36 in the same manner as the small weight 67.

As an example of a preferred embodiment of the bench press exercise machine 1, the lift bar 55 of the force station 36 is approximately 18 inches from the axis 8. The spotter bar 47 is approximately 72 inches from the axis 8. Assuming the first weights 63 weigh 100 pounds, and assuming the person has 25 percent greater muscle capability in the eccentric function than in the concentric function, the small applied weight 67, or the slight force by the spotter's hands, need be only approximately six pounds. A six pound applied force magnifies to a 24 pound gravitational load at the lift bar that the person resists during eccentric muscle functions. Maximum efficiency of the bench press exercise machine is thus achieved with but minimal effort on the part of the spotter. Because of the angled construction of the leverage beam second sections 41, the spotter does not have to reach very high in order to hang the small weight 67 or apply the manual force.

Figure 6:
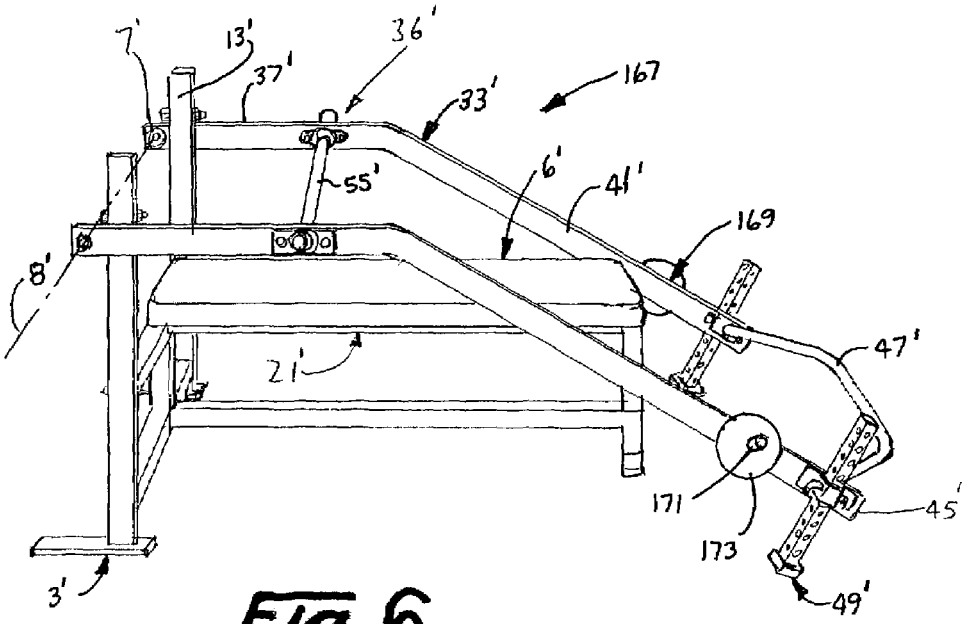
FIG. 6 is a perspective view of a modified embodiment the invention.

Looking at FIG. 6, a modified exercise machine 167 is illustrated. The modified exercise machine 167 is generally similar to the bench press exercise machine 1 described above. The exercise machine 167 has a frame 3' and a support 6' in the form of a bench press 21'. A leverage arm 169 is pivotally connected to the frame posts 13' by bearings 7' that define a pivotal connection axis 8'. The leverage arm 169 has two beams 33' each with a first section 37' and an angled second section 41'. There is an adjuster 49' on each beam 33' near a spotter bar 47'. The leverage arm has a force station 36' in the form of a lift bar 55' that extends between the first sections 37' of the two beams 33'.

The leverage arm 169 of the exercise machine 167 has two weight bars 171 on the associated beams 33'. The weight bars 171 are close to the spotter ends 45' of the beams 33' rather than at the force station 36'. First weights 173 placed on the weight bars 171 produce a magnified gravitational load at the lift bar 55'. For example, for an exercise machine 167 having the same dimensions as the exercise machine 1 previously described, first weights of 25 pounds produce the same load at the lift bar 55' as the 100 pounds first weights 63. Again a small weight or manual force of approximately six pounds on the spotter bar 47' produces a 25 percent increase in the force the exercising person must exert during eccentric muscle functions.

Returning to FIGS. 1–4, it will be recognized that the weight of the beams 33, lift arm 55, weight bars 59, and spotter bar 47 of the leverage arm 5 add to the gravitational load that the exercising person must overcome during the concentric muscle functions and resists during eccentric muscle functions. In some instances, it may be desirable to cancel out the weight of the leverage arm. For example, young persons and those at the beginning stages of their exercise regimens may not be able or willing to exert enough force to overcome and resist the weight of the leverage arm.

Figure 7:
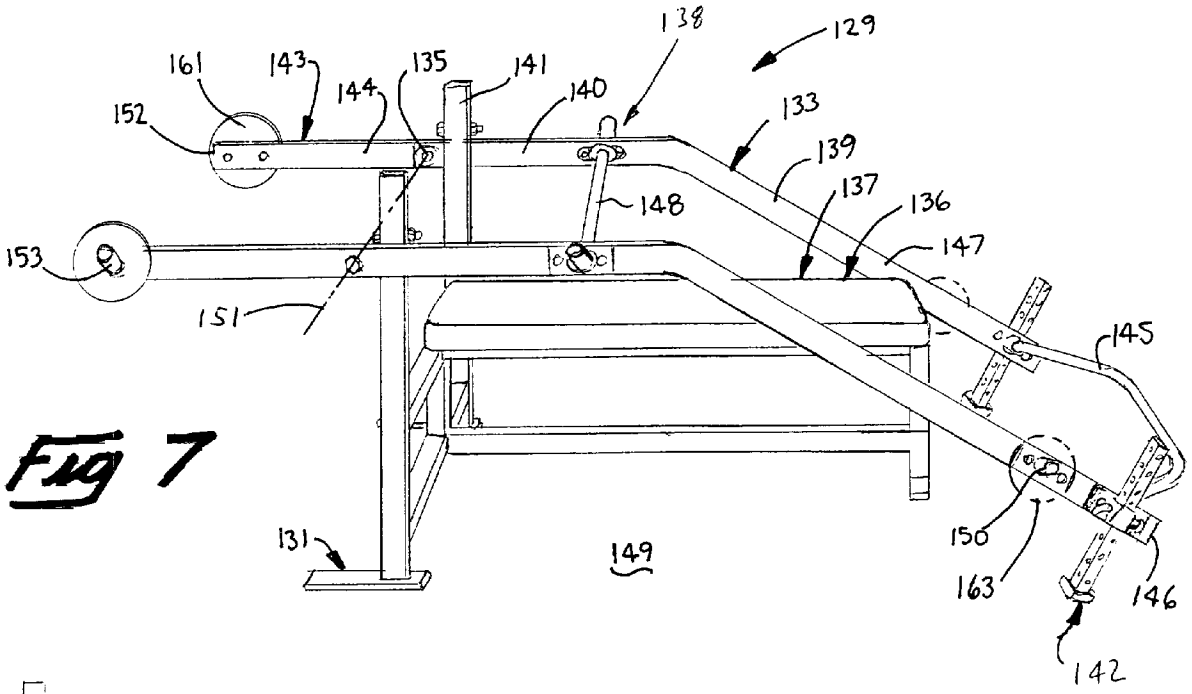
FIG. 7 is a perspective view of the embodiment of the invention of FIG. 6, but showing a counterbalance.

Turning to FIG. 7, an exercise machine 129 is capable of canceling out the weight of the leverage arm. The exercise machine 129 has a frame 131 that rests on a floor 149. A leverage arm 133 pivotally connects to the frame 131 at bearings 135. The exercise machine 129 has a support 136 attached to the frame. The support 136 is in the form of a bench 137. The leverage arm 133 includes a force station 138 located over the bench 137. As illustrated, the leverage arm has two parallel beams 139, each pivotally connected by means of a respective bearing 135 to a post 141 of the frame 131. In turn, each beam 139 is composed of a first section 140 next to the bearings, and a second section 147 next to the first section. The second sections 149 angle toward the floor 149 and terminate in respective spotter ends 146. The spotter ends 146 are joined to a spotter bar 145. Near the spotter end of each beam 140 is an adjuster 142 that is substantially similar to the adjuster 49 described previously in connection with the exercise machine 1.

For the bench press exercise machine 129, the force station 138 is a lift bar 148 that extends between and is secured to the beams 139 over the bench 137. The exercise machine 129 is depicted as having first weight bars 150 projecting outwardly and slightly upwardly from the second sections 147 of the beams 139 near their respective spotter ends 146. However, if desired, the weight bars could project outwardly from the force station 138 in line with the lift bar 148 in the manner of the exercise machine 1 of FIGS. 1–4.

The exercise machine 129 further includes a counterweight arm 143 that is on the opposite side of the bearings 135 as the leverage arm 133. In the preferred embodiment, the counterweight arm 143 is constructed as two counterweight beams 144 that are integral and colinear with the associated leverage arm beams 139. The counterweight beams 144 extend oppositely of the pivotal axis 151 from the respective leverage arm beams. At the free end 152 of each counterweight arm beam 144 is a counterweight bar 153.

Figure 8:
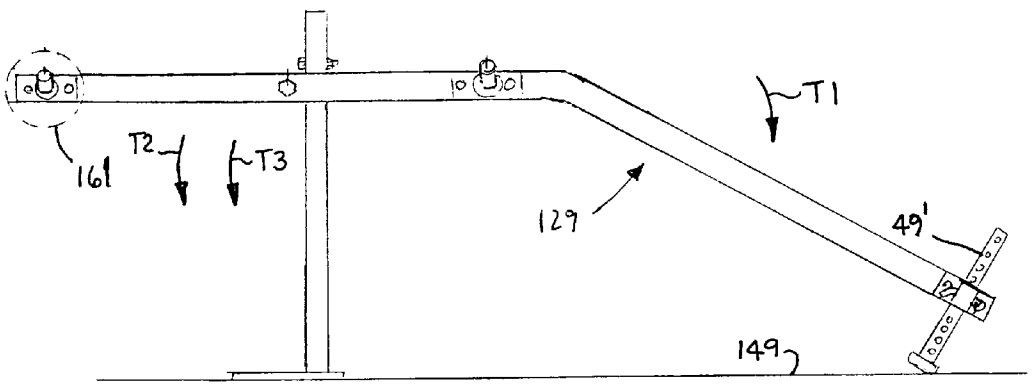
FIG. 8 is a schematic view of the torques involved with the exercise machine of FIG. 7.

Initially, no weights are put on either the first weight bars 150 or on the counterweight bars 153. In that situation, the weight of the leverage arm 133 creates a first torque T1 about the bearings 135. Also see FIG. 8. The weight of the counterweight arm 143 creates an opposite but much smaller second torque T2 about the bearings. As a result, the adjusters 142 rest on the floor 149. A person adds counterweights 161 to the counterweight bars to create a torque T3. The counterweights 161 are added until the value of the second torque T2 plus the torque T3 equals the first torque T1. At that point, the weight of the leverage arm is cancelled out.

The exercise machine 129 is used in a manner similar to the bench press exercise machines 1 and 167 described previously. The person places first weights 163 on the weight bars 150. During exercising, the person must overcome only the gravitational load of the first weights 163 during concentric muscle functions. A spotter, not shown, applies a small weight or force with his hands to the spotter bar 145 during eccentric muscle functions of the exercising person, as explained previously.

Further in accordance with the present invention the physics principles associated with the leverage arm is adaptable to numerous types of exercise machines. In each case, the exercise machine comprises a frame, a support for a person's body, and a leverage arm with a force station. Further, the principles associated with the counterweight arms and counterweights are applicable to numerous types of exercise machines. For example, as explained, the exercise machine 129 with the counterweight arm 143 and counterweights 161 is depicted as being in the form a bench press machine. Looking at FIG. 9, an exercise machine 69 with a leverage arm is shown that is particularly useful for exercising the legs by using squat and calf raise type exercises. The exercise machine 69 has a stable tripod-type frame 71 that is illustrated as having two upright posts 73 tied together with transverse braces 75 and 77 and a stabilizer 80. The lower ends of the posts 73 may have foot plates 79 that rest on a floor 19'. The stabilizer 80 has a footplate 84 that rests on the floor 19'. The exercise machine 69 further has a support 86 that supports a person for performing squat and similar type exercises. The support 86 comprises a platform 82 that is attached to the frame stabilizer 80. Depending on the particular construction of the exercise machine 69, the platform 82 may also be attached to the frame brace 75. Although illustrated as being parallel to the floor 19', the platform 82 may be at an angle to the floor such that it tilts upwardly toward the brace 75.

A leverage arm 81 is pivotally connected to the frame posts 73 at bearings 74. The distance of the bearings 74 above the support platform 82 is approximately five feet. The particular leverage arm 81 illustrated has two parallel beams 85 with respective spotter ends 87. Each beam 85 has a first section 76 and a second section 78 that angles toward the floor 19'. The spotter ends 87 of the beams 90 are joined by a spotter bar 104. There is an adjuster 106 and weight bar 108 on each beam 85 near its spotter end 87.

The exercise machine 67 further has a counterweight arm 88 in the form of two beams 90 that are integral and co-planer with associated leverage arm beams 85. At the free end 92 of each counterweight beam 90 is a counterweight bar 96 on which can be placed a counterweight 98.

There is a force station 94 between the leverage arm spotter ends 87 and the bearings 74. In the particular squat-type exercise machine 69 illustrated, the force station 94 comprises a comfortable pad 121 on each beam 85.

To use the exercise machine 69, a person stands on the support 86. He places his shoulders against the pads 121. He exerts his leg muscles in a concentric function to pivot the leverage arm 81 in the direction of arrow 125. At the end of the concentric muscle function a spotter (not shown) applies a small weight or manual force to the spotter bar 104. The small applied force creates a magnified load at the pads 121. Consequently, the exercising person must, and is able, to exert a greater force during the eccentric muscle function.

Figure 10:
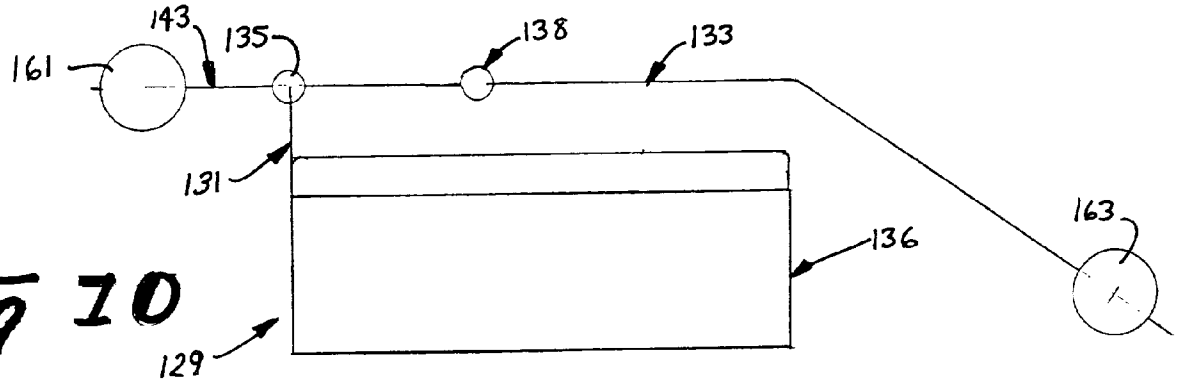
FIG. 10 is a schematic view of the major components of the exercise machine of FIGS. 7 and 8.
Figure 11:
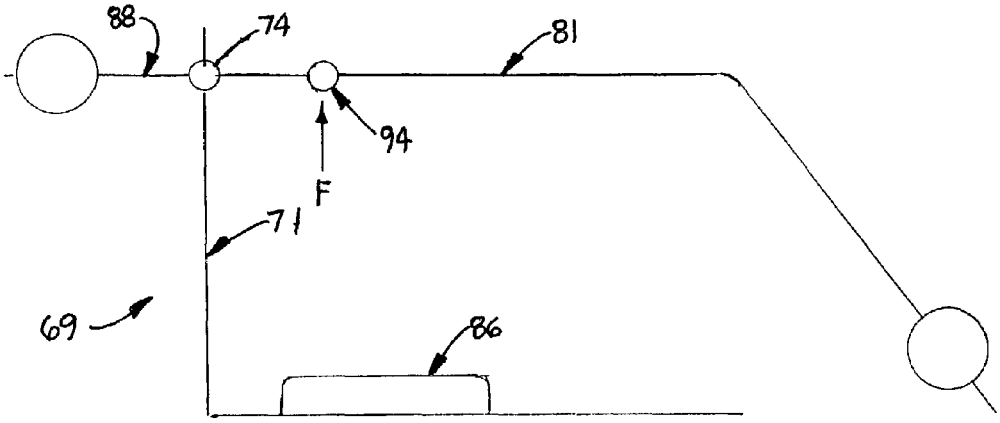
FIG. 11 is a schematic view of the major components of the exercise machine of FIG. 9.

FIGS. 10–12 show in diagrammatic form the principles of the present invention as applied to several different types of exercise machines. FIG. 10 is the diagrammatic representation of the bench press exercise machine 129 of FIGS. 7 and 8. In FIG. 10, the frame is at reference numeral 131, the support for the exercising person is at reference numeral 136, and the leverage arm is at reference numeral 133. The leverage arm pivots at bearings 135 about the frame in response to exertion by the exercising person at the force station 138. The weight of the leverage arm is initially cancelled out by adding counterweights 161 to the counterweight arm 143. Thus, the exercising person is required to exert only enough force only to overcome the gravitational load of the first weights 163 during concentric muscle functions, plus the small force applied to the spotter bar during eccentric muscle functions.

Figure 9:
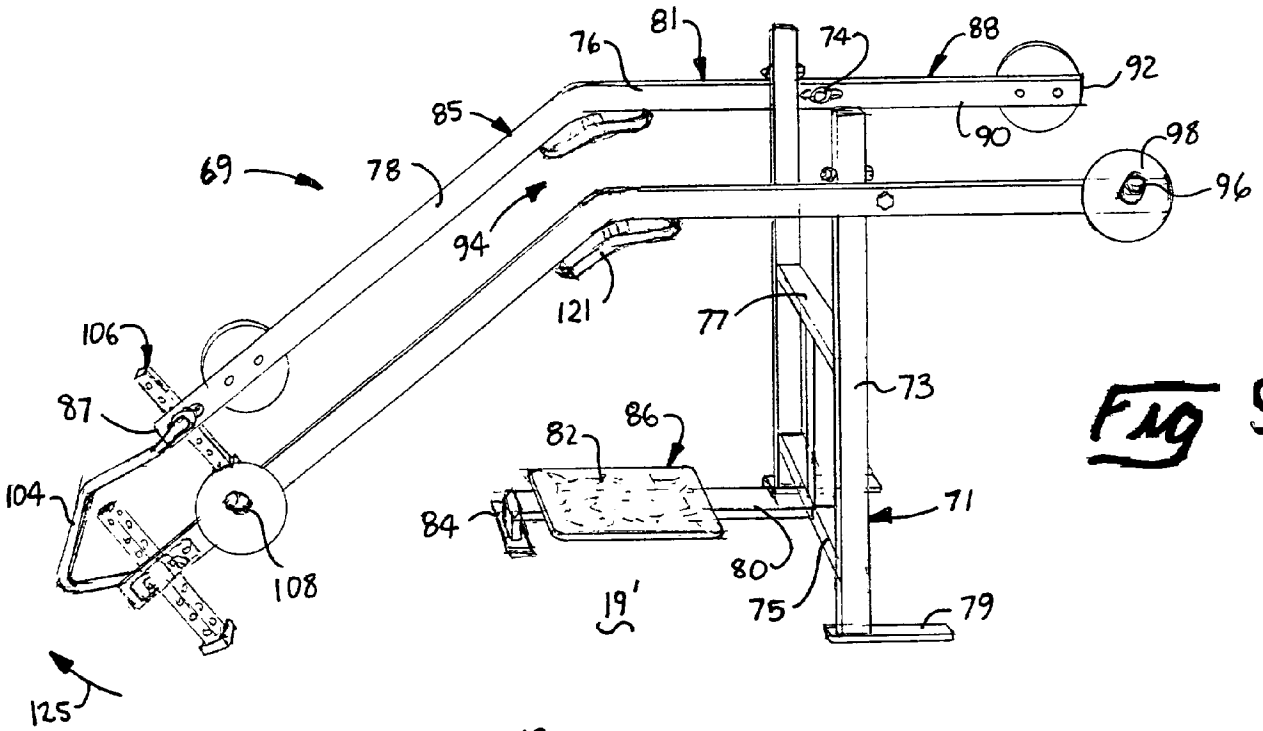
FIG. 9 is a perspective view of an alternate exercise machine according to the present invention.

FIG. 11 is a diagrammatic representation of the squat-type exercise machine 69 of FIG. 9. The leverage arm 81 and counterweight arm 88 pivot about the frame 71 by means of the bearings 74. A person stands on the support 86 and exerts a force F against the force station 94. The exercise machine 69 is particularly useful for standing calf and squat-type exercises. The exercise machine 69 is also useful for shrug-type exercises.

Figure 12A:
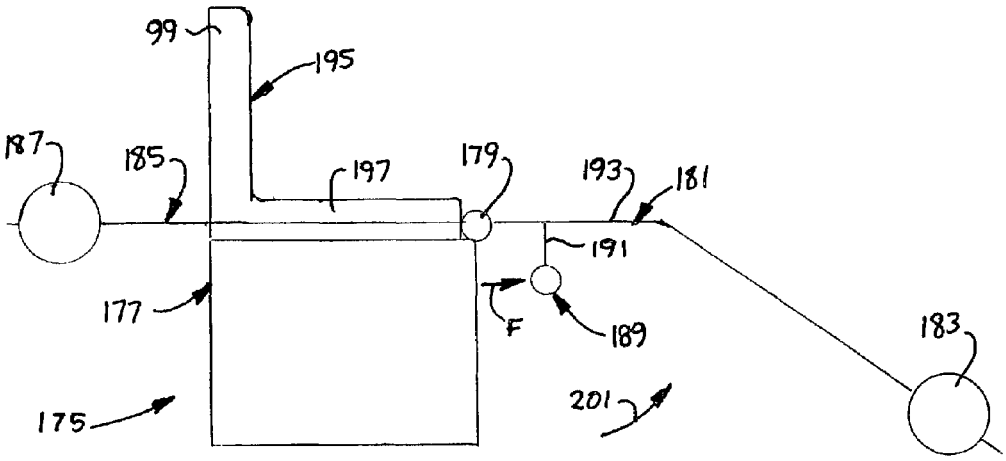
FIGS. 12A–12K are schematic views of the major components of further alternate exercise machines according to the present invention.

FIG. 12A is a diagrammatic illustration of a calf raise exercise machine 175. The exercise machine 175 has a frame 177 with bearings 179. A leverage arm 181 with first weights 183 pivots about the bearings 179. The exercise machine 175 is shown with a counterweight arm 185 and counterweights 187. The force station 189 of the exercise machine 175 is in the form of a pair of short plates 191 depending from first sections 193 of the leverage arm 181. The support 195 comprises a seat section 197 and a vertical section 199.

A person uses the exercise machine 175 by kneeling on the support 195. He places his knees at the junction of the support sections 197 and 199 and places the balls of his feet against the force station 189. By exerting a force F with his calf muscles in a concentric function, the person is able to pivot the leverage arm 181 in the direction of arrow 201 against the gravitational load of the weights 183. A spotter applies a small weight or hand force to the leverage arm in the manner previously described for eccentric muscle functions.

Figure 12B:
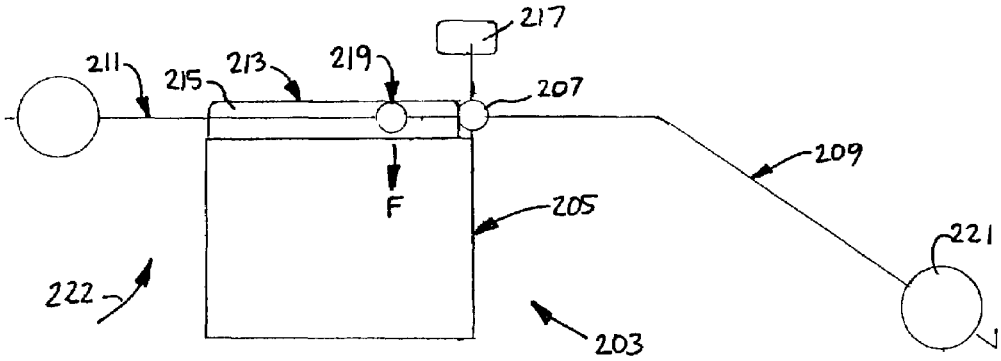

FIG. 12B shows an exercise machine 203 for performing dip exercises, also known as power triceps exercises. The exercise machine 203 has a frame 205, bearings 207, leverage arm 209, and counterweight arm 211. The support 213 is in the form of a seat 215 and a thigh restraint 217. The force station 219 is on the opposite side of the bearings 207 as the first weights 221 on the leverage arm 209.

A person uses the exercise machine 203 by sitting on the support seat 215 and putting his thighs under the restraint 217. With his arms, the person pushes downwardly with a force F in a concentric muscle function at the force station 219. The leverage arm 209 and the first weights 221 pivot in the direction of arrow 222 during concentric muscle functions.

Figure 12C:
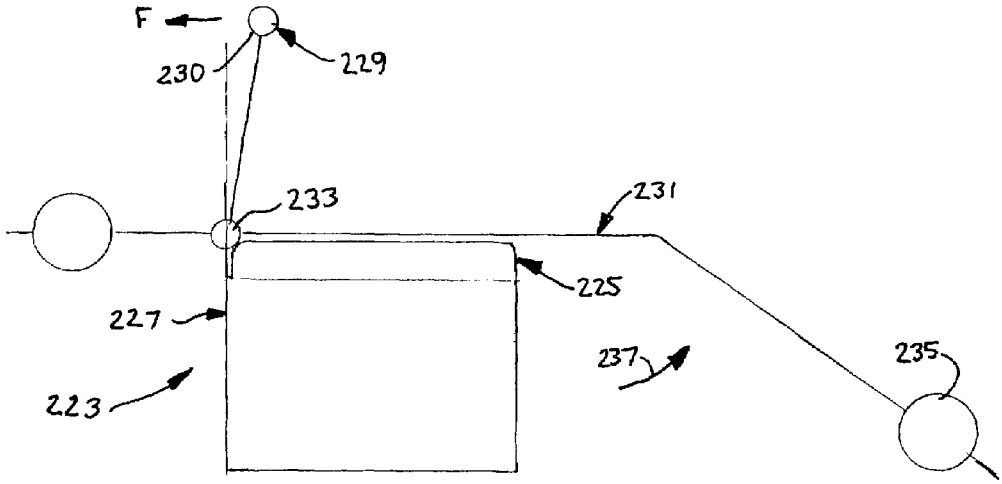

FIG. 12C shows an exercise machine 223 that is particularly useful for exercising the lower back of a person. The support 225 is a horizontal seat, which is on a tripod frame 227. The force station 229 is in the form of a pad 230 on the leverage arm 231. The pad 230 upstands from the leverage arm 231 in line with the common axis of the bearings 233. A person sits on the support seat 225 with his shoulders against the pad 230. By a concentric muscle function, the person exerts a force F backwardly against the pad 230 to pivot the leverage arm 231 and first weights 235 in the direction of arrow 237.

Figure 12D:
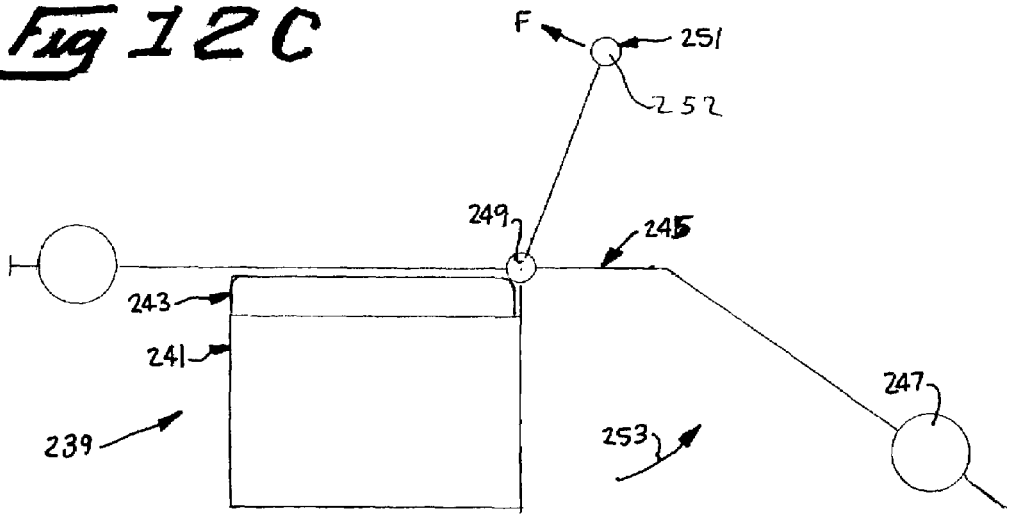

FIG. 12D illustrates in diagrammatic form an exercise machine 239 for exercising abdominal muscles. The exercise machine 239 has a tripod-type frame 241 to which is attached a support in the form of a seat 243. A leverage arm 245 with first weights 247 pivots about bearings 249. The force station 251 is a pad 252 on the leverage arm 245. A person sits on the support seat 243 with his chest against the pad 252. He exerts a force F in a forward motion to pivot the leverage arm 245 and first weights 247 in the direction of arrow 253.

Figure 12E:
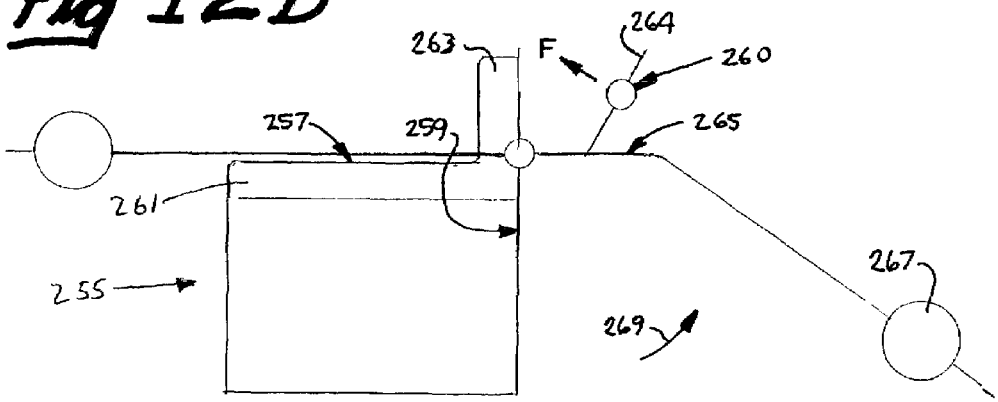

FIG. 12E shows in diagrammatic form the principles of the present invention applied to a seated rowing exercise machine 255. A support 257 on a frame 259 has a horizontal seat 261 and an upright chest support 263. The force station 260 is a pair of handle grips 264 on the leverage arm 265. The exercising person sits on the support seat 261 with his chest against the support upright 263. By pulling with his arms on the handle grips 264, the person pivots the leverage arm 265 and first weights 267 in the direction of arrow 269.

Figure 12F:
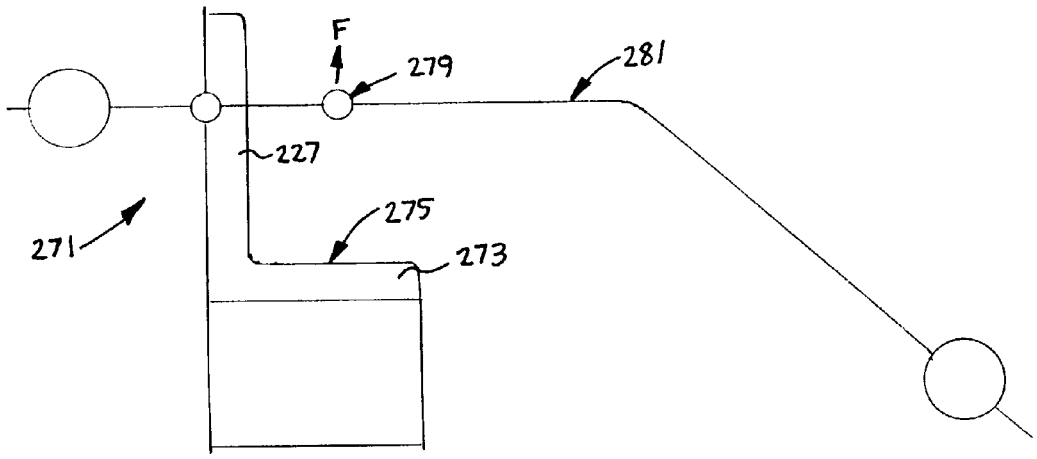

FIG. 12F diagrammatically represents a shoulder press exercise machine 271. A person sits on a seat 273 of a support 275 with his back against a backrest 277 of the support. A force station 279 of a leverage arm 281 is at a height above the seat 273 to enable the person to grip a handle there and exert an upward force F.

Figure 12G:
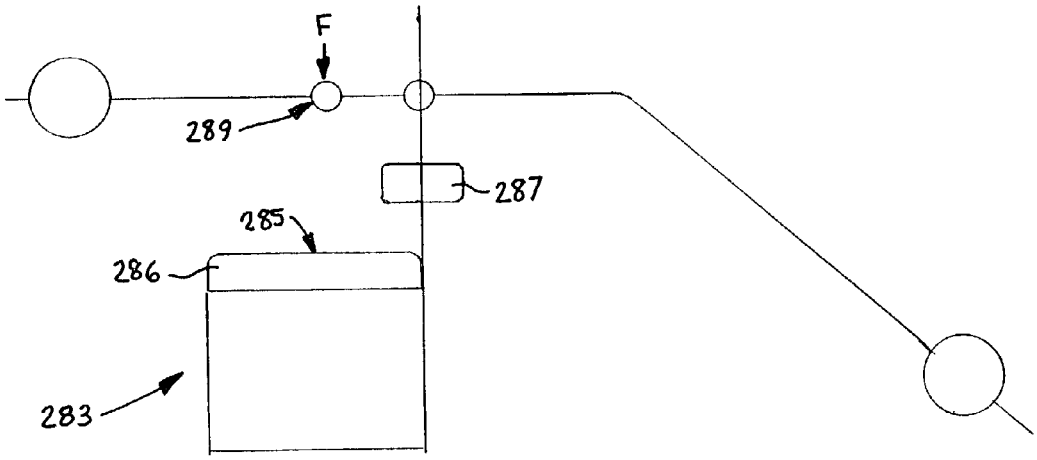

FIG. 12G shows a lateral pull exercise machine 283. A support 285 has a seat 286 and a thigh restraint 287. A person sits on the seat 286 with his thighs under restraint 287. The force station 289 is above the support 285 such that the person can grip a handle there and pull downwardly with a force F.

Figure 12H:
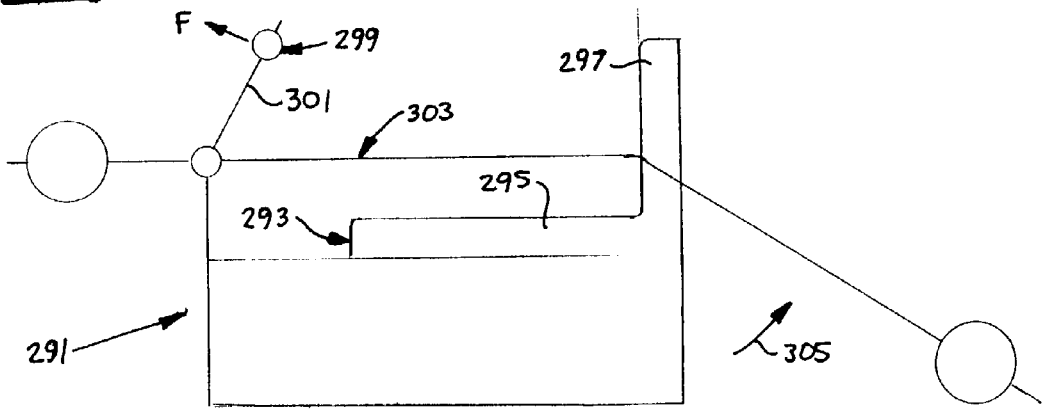

FIG. 12H represents a leg press exercise machine 291. A support 293 has a seat 295 and a backrest 297. A person sits on the seat 295 with his back against the backrest 297. He places his feet at a force station 299, which is a plate 301 on the leverage arm 303. By pushing with his legs in a concentric muscle function, the person exerts a force F to pivot the leverage arm 303 in the direction of arrow 305.

Figure 12I:
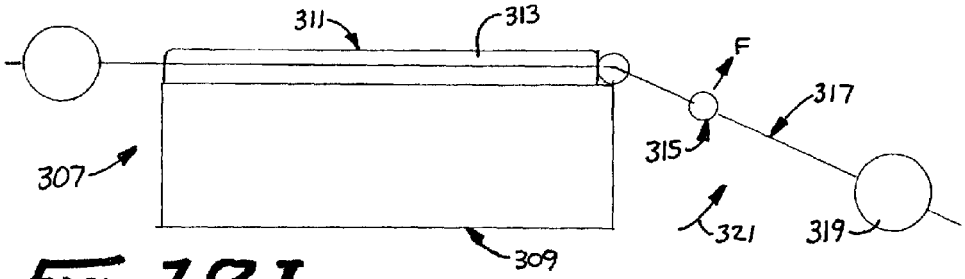

FIG. 12I shows in diagrammatic form an exercise machine 307 useful for leg curl exercises. The exercise machine 307 has a frame 309 with a support 311 in the form of a horizontal bench 313. A person sits on the bench 313 and places the tops of his feet against a force station 315. By a concentric muscle function of the appropriate muscles in his legs, the person exerts a force F at the force station 315 to pivot the leverage arm 317 and first weights 319 in the direction of arrow 321.

Figure 12J:
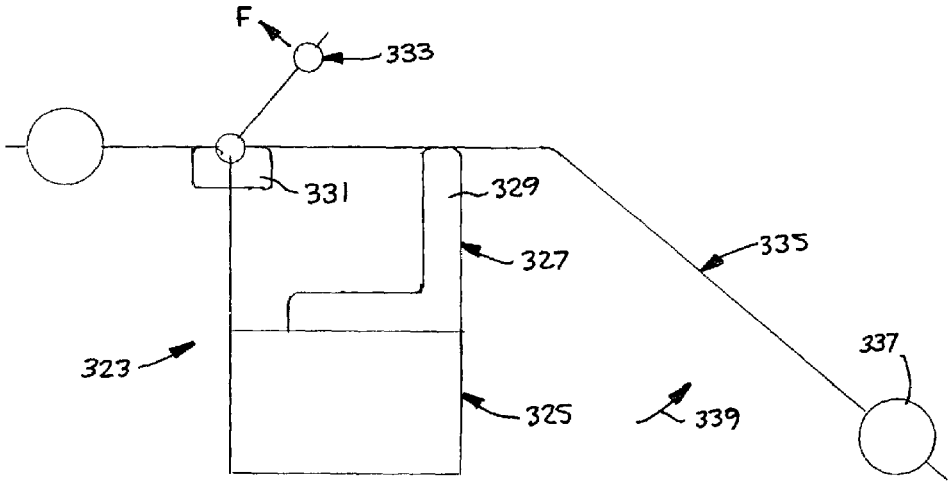

FIG. 12J is a diagrammatic representation of a triceps exercise machine 323 according to the present invention. A tripod-type frame 325 has a support 327 that is in two parts. The first part of the support 327 is a combination seat and backrest 329. The second part is a pad 331 above the seat and backrest 329. A person sits on the seat and backrest and places his elbows on the pad 331. With his hands he grips handles at the force station 333. Exertion of a force F in a concentric function with his triceps causes the leverage arm 335 and first weights 337 to pivot in the direction of arrow 339.

Figure 12K:
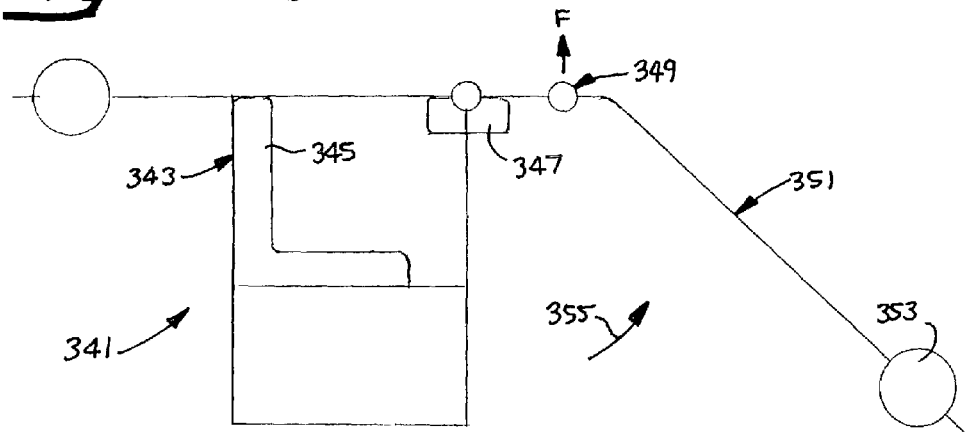

FIG. 12K shows in diagrammatic form an exercise machine 341 for exercising a person's biceps muscles. A support 343 has a seat 345 and a pad 347 above the seat. A person sits on the seat 345 and places his elbows on the pad 347. He grips handles at the force station 349 and exerts a force F to pivot the leverage arm 351 and first weights 353 in the direction of arrow 355.

Each of the exercise machines 175, 203, 223, 239, 255, 271, 283, 291, 307, 323, and 341 of FIGS. 12A–12K, respectively, is shown with a counterweight arm and a counterweight, such as counterweight arm 185 and counterweight 187 of the exercise machine 175. However, as explained previously, the counterweight arms and counterweights may be eliminated, if desired, without departing from the principles and inventive concepts of the present invention. Similarly, the exercise machines of FIGS. 12A–12K show the first weights, such as first weights 183 of the exercise machine 175 (FIG. 12A), as being close to the spotter ends of the respective leverage arms. However, for each exercise machine, the first weights may be close to or at the respective force stations as described in connection with exercise machine 1 of FIGS. 1–4.

For each of the exercise machines, 175, 203, 223, 239, 255, 271, 283, 291, 307, 323, and 341, the exercising person exerts a force in a concentric muscle function to overcome the first weights placed on the leverage arm. At the end of each concentric muscle function, a spotter applies a small weight or force with his hands to the leverage arm. The applied force imposes an increased gravitational load that the person is capable of controlling during the eccentric muscle functions.

In summary, the results and advantages of the different capabilities of human muscles in concentric and eccentric functions can now be more fully realized. The exercise machines of the present invention provide maximum efficiency when exercising various muscles. This desirable result comes from using the combined functions of the leverage arm. An exercising person pivots the leverage arm with first weights thereon in traditional concentric muscle functions. A small weight or manual force applied to the leverage arm spotter bar is magnified at the force station during eccentric muscle functions. The length of the leverage arm enables only a small weight or manual force applied to the spotter bar to have a significant effect at the force station. The principles of the present invention are applicable to a wide variety of exercise machines, which all have in common a tripod-type frame, a support for a person, and a leverage arm. The type of support and its location relative to the force station are variable for different embodiments of the invention to suit different exercising muscles. An optional counterweight arm and counterweights cancel out the weight of the leverage arm.

It will also be recognized that in addition to the superior performance of the exercise machines, their construction is such as to be less costly than traditional exercise machines. Also, since they are made of rugged materials and a simple design, the need for maintenance is practically eliminated.

Thus, it is apparent that there has been provided, in accordance with the invention, an exercise machine with leverage arm that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An exercise machine comprising:

a. a frame resting on a floor, wherein the frame comprises a pair of upstanding posts having respective lower ends that rest on the floor, and a stabilizer fixed to the posts and having an end that rests on the floor;

b. at least one bearing on the frame that defines a pivotal axis, said at least one bearing comprises a bearing on each post;

c. a leverage arm connected to said at least one bearing for pivoting about the pivotal axis, and for holding a first weight, the leverage arm having a spotter end at a first distance from the pivotal axis, and a force station at a second distance less than the first distance from the pivotal axis, wherein the ratio of the first distance to the second distance is approximately four to one; and d. a support attached to the frame at a predetermined location relative to the force station that enables a person to be supported on the support and to contact the force station with selected parts of the person such that exertion of selected muscles on the force station in a concentric function pivots the leverage arm in a first direction, and a small force applied to the leverage arm spotter end at the end of the concentric muscle function by the person causes the person to exert the selected muscles in an eccentric function and controllably pivot the leverage arm in a second direction.

2. The exercise machine of claim 1 wherein:

a. the leverage arm further comprises a pair of beams each pivotally connected to a respective bearing and each having a spotter end; and b. a spotter bar is joined to the beams proximate the spotter ends thereof.

3. The exercise machine of claim 2 wherein the first weight is generally aligned with the leverage arm spotter bar.

4. The exercise machine of claim 2 wherein:

a. the leverage arm possesses a weight that creates a first torque about the pivotal axis; and b. the exercise machine further comprises:

i. a counterweight arm extending from and oppositely of the pivotal axis as the leverage arm;

ii. a counterweight on the counterweight arm, the counterweight arm and the counterweight cooperating to create a second torque about the pivotal axis that is equal and opposite the first torque.

5. The exercise machine of claim 2 wherein:

a. each leverage arm beam has a first section adjacent the pivotal axis, and a second section that angles toward the floor such that the spotter ends of the beams are proximate the floor; and b. the exercise machine further includes an adjuster on each leverage arm beam that cooperates with the floor to adjust the angular orientation of the leverage arm beams relative to the floor.

6. The exercise machine of claim 2 wherein the small force applied to the leverage arm spotter end is a small weight hung on the spotter bar.

7. The exercise machine of claim 1 further comprising means for adjusting the angular orientation of the leverage arm relative to the floor.

8. The exercise machine of claim 7 wherein the means for adjusting comprises at least one adjuster assembled to the leverage arm and having a foot that rests on the floor and that is adjustably maintained relative to the leverage arm.

9. The exercise machine of claim 1 wherein:

a. the leverage arm possesses a selected total weight; and b. the exercise machine further comprises means for counterbalancing the selected total weight of the leverage arm, so that the selected total weight of the leverage arm is cancelled during concentric and eccentric muscle functions by the person.

10. The exercise machine of claim 1 wherein the support comprises a bench attached to the frame and underlying the leverage arm force station at a predetermined distance therefrom sufficient to enable for the person to lie on the bench and contact the force station with hands.

11. The exercise machine of claim 1 wherein the support comprises a platform attached to the frame that enables the person to stand on the platform and contact the force station with shoulders.

12. The exercise machine of claim 1 wherein:

a. the force station comprises at least one plate on the leverage arm; and b. the support comprises a seat and a vertical rest attached to the frame, the support being located relative to the force station plate to enable the person to sit on the support and place feet of the person against said at least one plate, so that exerting calf muscles in concentric and eccentric functions pivots the leverage arm about the pivotal axis.

13. The exercise machine of claim 1 wherein the small applied force is a second weight applied to the leverage arm spotter end, so that the leverage arm and first and second weights pivot in the second direction during the eccentric muscle function.

14. An exercise machine comprising:

a. a frame resting on a floor;

b. at least one bearing on the frame that defines a pivotal axis;

c. a leverage arm connected to said at least one bearing for pivoting about the pivotal axis, and for holding a first weight, the leverage arm having a spotter end at a first distance from the pivotal axis, and a force station at a second distance less than the first distance from the pivotal axis, wherein the ratio of the first distance to the second distance is approximately four to one, wherein the first weight is generally aligned with the force station; and d. a support attached to the frame at a predetermined location relative to the force station that enables a person to be supported on the support and to contact the force station with selected parts of the person such that exertion of selected muscles on the force station in a concentric function pivots the leverage arm in a first direction, and a small force applied to the leverage arm spotter end at the end of the concentric muscle function by the person causes the person to exert the selected muscles in an eccentric function and controllably pivot the leverage arm in a second direction.

15. An exercising machine comprising:

a. a frame resting on a floor, the frame comprising a pair of upstanding posts having respective lower ends that rest on the floor, and a stabilizer fixed to the posts and having an end that rests on the floor;

b. at least one bearing on the frame that defines a pivotal axis, said at least one bearing comprising a bearing on each post;

c. a leverage arm connected to said at least one bearing for pivoting about the pivotal axis, and for holding a first weight, the leverage arm having a spotter end at a first distance from the pivotal axis, and a force station at a second distance less than the first distance from the pivotal axis, and wherein the leverage arm further comprises a pair of beams each pivotally connected to a respective bearing and each having a spotter end;

d. a support attached to the frame at a predetermined location relative to the force station that enables a person to be supported on the support and to contact the force station with selected parts of the person such that exertion of selected muscles on the force station in a concentric function pivots the leverage arm in a first direction, and a small force applied to the leverage arm spotter end at the end of the concentric muscle function by the person causes the person to exert the selected muscles in an eccentric function and controllably pivot the leverage arm in a second direction; and e. a spotter bar, said spotter bar being joined to the beams proximate the spotter ends thereof; the spotter bar being bowed outwardly from the beam spotter ends to thereby enable a spotter to apply the small force to the spotter bar without interfering with the person.

16. An apparatus for exercising selected muscles comprising:

a. a frame resting on a floor;

b. a leverage arm connected to the frame for pivoting about a pivotal axis and having a spotter end at a first distance from the pivotal axis, and a force station at a second distance less than the first distance from the pivotal axis, the ratio of the first distance to the second distance being approximately four to one;

c. first weights on the leverage arm, wherein the first weights are approximately aligned with the force station; and d. means for supporting a person at a location that enables the person to exert a first force on the force station in a concentric muscle function and pivot the leverage arm in a first direction, and that enables the person to exert a second force greater than the first force on the force station in an eccentric muscle function in response to applying a small force to the leverage arm spotter end at the end of the concentric muscle function and controllably pivot the leverage arm in a second direction.

17. The apparatus of claim 16 wherein:

a. the frame comprises a pair of upstanding posts;

b. the leverage arm comprises a pair of beams each pivotally connected to a respective post and each terminating in a respective spotter end; and c. a spotter bar is joined to the beams proximate the spotter ends thereof.

18. The apparatus of claim 17 wherein:

a. the leverage arm beams, spotter bar, and force station possess selected weights that create a first torque about the pivotal axis; and b. the apparatus further comprises a counterweight beam in operative association with each leverage arm beam and on the opposite side of the pivotal axis as the associated leverage arm beam, and counterweights on the counterweight beams that cooperate therewith to create a second torque about the pivotal axis equal and opposite the first torque.

19. The apparatus of claim 17 wherein the small force applied to the leverage arm spotter end is a small weight hung on the spotter bar.

20. The apparatus of claim 16 wherein the means for supporting a person comprises a bench attached to the frame at a selected location between the force station and the floor and closer to the force station than to the floor to render the apparatus to be a bench press exercise machine.

21. The apparatus of claim 16 further comprising means for adjusting the angular orientation of the leverage arm relative to the floor.

22. The apparatus of claim 16 wherein:

a. the leverage arm and force station possess respective selected weights that create a first torque about the pivotal axis; and b. the apparatus further comprises means for creating a second torque about the pivotal axis that cancels out the first torque.

23. The apparatus of claim 19 wherein the small force applied to the leverage arm spotter end comprises a small weight applied to the leverage arm spotter end.

24. An apparatus for exercising selected muscles comprising:

a. a frame resting on a floor, wherein the frame comprises a pair of upstanding posts;

b. a leverage arm connected to the frame for pivoting about a pivotal axis and having a spotter end at a first distance from the pivotal axis, and a force station at a second distance less than the first distance from the pivotal axis, the ratio of the first distance to the second distance being approximately four to one, wherein the leverage arm comprises a pair of beams each pivotally connected to a respective post and each terminating in a respective spotter end, and wherein a spotter bar is joined to the beams proximate the spotter ends thereof;

c. an adjuster on each leverage arm beam near the spotter end thereof, each adjuster being adjustable relative to the associated beam to thereby change the angular orientation of the beam relative to the floor;

d. first weights on the leverage arm; and e. means for supporting a person at a location that enables the person to exert a first force on the force station in a concentric muscle function and pivot the leverage arm in a first direction, and that enables the person to exert a second force greater than the first force on the force station in an eccentric muscle function in response to applying a small force to the leverage arm spotter end at the end of the concentric muscle function and controllably pivot the leverage arm in a second direction.

25. The apparatus of claim 24 wherein the first weights are proximate the leverage arm spotter end.

26. The apparatus of claim 24 wherein the means for supporting a person comprises a platform attached to the frame at a selected location between the force station and the floor and closer to the floor than to the force station to render the apparatus to be a squat-type exercise machine.

27. The apparatus of claim 24 wherein the means for supporting a person comprises a seat section and a vertical section each attached to the frame and at respective locations relative to the force station to render the apparatus a calf exercise machine.

28. The apparatus of claim 24 wherein each beam has a first section adjacent the pivotal connection, and a second section that angles toward the floor and that terminates in the associated spotter end.

29. The apparatus of claim 24 wherein the means for supporting a person comprises a seat and a pad each attached to the frame and located relative to the force station to render the apparatus an exercise machine for exercising triceps or bicep muscles of the person.

30. An apparatus for exercising selected muscles comprising:

a. a frame resting on a floor, the frame comprising a pair of upstanding posts;

b. a leverage arm connected to the frame for pivoting about a pivotal axis and having a spotter end at a first distance from the pivotal axis, and a force station at a second distance less than the first distance from the pivotal axis, the leverage arm comprising a pair of beams each pivotally connected to a respective post and each terminating in a respective spotter end;

c. first weights on the leverage arm;

d. means for supporting a person at a location that enables the person to exert a first force on the force station in a concentric muscle function and pivot the leverage arm in a first direction, and that enables the person to exert a second force greater than the first force on the force station in an eccentric muscle function in response to applying a small force to the leverage arm spotter end at the end of the concentric muscle function and controllably pivot the leverage arm in a second direction; and e. a spotter bar, said spotter bar being joined to the beams proximate the spotter ends thereof, the spotter bar being bowed outwardly from the leverage arm beams spotter end.

* * * * *